United States Patent [19]

Slanker et al.

[11] Patent Number: 4,850,296

[45] Date of Patent: Jul. 25, 1989

[54] PORTAGING ASSIST

[76] Inventors: Douglas G. Slanker, 191 Indian Grove, Ontario, Canada, M6P 2H4; Edward Gillis, 45 Glenlake Avenue, Toronto, Ontario, Canada, M6P 1E2

[21] Appl. No.: 157,622

[22] Filed: Feb. 19, 1988

[51] Int. Cl.[4] ..... B63B 17/00

[52] U.S. Cl. ..... 114/343; 114/347; 224/191; 224/265

[58] Field of Search ..... 114/343, 347, 364; 224/191, 202, 205, 257, 259, 264, 265

[56] References Cited

U.S. PATENT DOCUMENTS 3,105,359 10/1963 Ellis ..... 224/202 X 4,016,615 4/1977 Main ..... 114/347

4,236,267 12/1980 Lewis et al. ..... 114/347

*Primary Examiner*—Sherman D. Basinger

*Attorney, Agent, or Firm*—Kenneth M. Garrett

[57] ABSTRACT

A fabric sleeve has a resilient, bouyant pad on one outward facing side thereof and a flap at one end of the sleeve for detachably securing the sleeve to the thwart of a small water craft such as a canoe. The blade of a paddle may be inserted into the sleeve to secure the blade when the craft is portaged, the pad serving to cushion the weight of the craft on the shoulder of a portageur. A closable pocket is suitably secured to the outside wall of the sleeve opposed to the pad, the device thereby serving to store small articles aboard the craft. Conveniently the fabric sleeve forms a common wall of the pocket and an enclosure for the pad.

15 Claims, 2 Drawing Sheets

PORTAGING ASSIST

FIELD OF INVENTION

This invention relates to water craft, as exemplified by canoes.

BACKGROUND OF INVENTION

It is often required to portage canoes. For this purpose, particularly when the portage is over an extended distance or over difficult terrain, a pair of paddles are lashed with their handles to the gunwhales adjacent the bow, and with the blades to a centre thwart of the canoe in a V formation as seen in plain view. The canoe is then inverted over the portageur with the blades resting on the shoulder thereof. Temporary padding in the nature of spare clothing or towels is usually draped around the shoulders to cushion the load.

It is often desired to provide for the storage of small articles in a canoe. Desirably the storage means should provide flotation for the contents, be attachable to the canoe with some security and yet be readily removable in an emergency.

The present invention provides a device for easily and rapidly securing paddles to the thwarts of a canoe in preparation for portaging. It further provides a suitable cushion for the load of the canoe when portaged.

In its preferred form, the portaging device is adapted to provide a storage pocket, and the cushion serves as a flotation means therefor.

SUMMARY OF THE INVENTION

In accordance with a broad aspect of the invention, a portaging device comprises a flexible sleeve having an axis therealong and including an opening at at least one axial end thereof for receiving a paddle blade therein. A resilient pad is secured to the sleeve on one major surface thereof, and means is provided locating at the axial end of the sleeve opposed to the opening for securing the sleeve to the thwart of a canoe.

Preferably the sleeve is open at both axial ends thereof, so that the paddle blade may be inserted through the sleeve.

The securing means is conveniently provided by a flap means which may be formed at least in part by an extension of a major surface opposed to that to which the pad is secured. The flap means wraps over the thwart, and is releasably secured into a closed hoop suitably by a hook and pile fastener.

In accordance with the preferred embodiment, the sleeve has a pocket secured to a major surface of the sleeve opposed to that which the pad is secured. Desirably the major surface of the sleeve to which the pocket is secured forms a wall of the pocket.

The invention will now be described in relation to the preferred embodiments thereof taken in conjunction with the drawings, and from which other aims, objects and advantages of the invention will become apparent.

DESCRIPTION OF THE PREFERRED EMBODIMENTS

Figure 1:
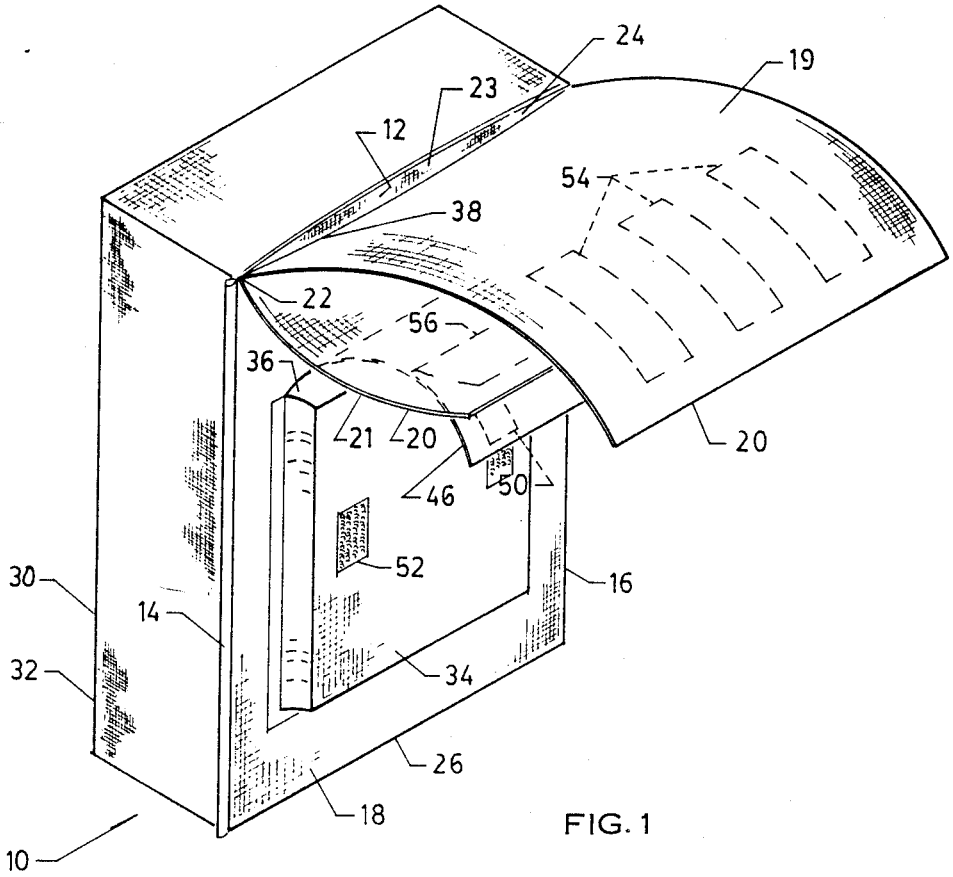
FIG. 1 is a perspective view of the portaging assist, with the flaps thereof being shown in an outwardly extending position for clarity, and with structure on the underside of the flaps shown in dashed outline.

Referring to the drawings in detail, a portaging assist constructed in accordance with the invention is identified therein by the numeral 10. Assist 10 comprises a first sheet of a textile fabric material 12 of generally rectangular shape, and secured thereto about an opposed pair of margins 14,16 is a second sheet 18 of similar material coextensive with first sheet 12 in its width, but extending beyond it in one axial direction to form the upper part 19 of a flap 20. Flap 20 further comprises a lower portion 21, which is conveniently secured to second sheet 18 by sewing at 22. Sheets 12,18 together form a sleeve 23 which is open at each axial end at 24,26. The dimensions of sheets 12,18 are not critical, and typically may be about eighteen to twenty cms. (seven to eight inches). A sleeve 23 so constructed will permit the blade B of most recreational paddles P to be received snugly therethrough.

Sleeve 23 is provided on the face thereof opposed to that on which flap 20 is located with a cushion pad 28 formed by a block of resilient foam material 29, such as polyurethane foam, which is suitably coextensive with the surface of the sleeve to which it attaches. Foam block 29 overlays sheet 12 on the outer face thereof and is secured thereto by any convenient means, and suitably fabric material 30 forms a closed pocket 32 therefor, together with sheet 12 to which fabric 30 is conveniently hemmed at 14,16.

On the outer face of sleeve 23 on which flap 20 locates i.e. opposed to that outer face upon which cushion pad 28 locates, there is formed a pocket 34 having an opening 36 locating adjacent the proximal edge 38 of flap 20. Pocket 34 is conveniently formed from similar fabric material to that of sheets 12 and 18, and is hemmed to sheet 18 at 40, sheet 18 therefore being common to sleeve 23 and pocket 34. A closure flap 46 is provided for pocket 34. Flap 46 is provided on its inward face with tabs 50 comprising one of a hook and pile fastener, and pocket 34 on its outer face with complementary fastener tabs 52. Flap 20 is suitably provided on its inward face with elongated tabs 54,56 of complementary hook and pile fastener.

While it is believed that the use of portaging assist 10 will be apparent from the foregoing description of its construction, the following is given for the sake of clarity.

Figure 2:
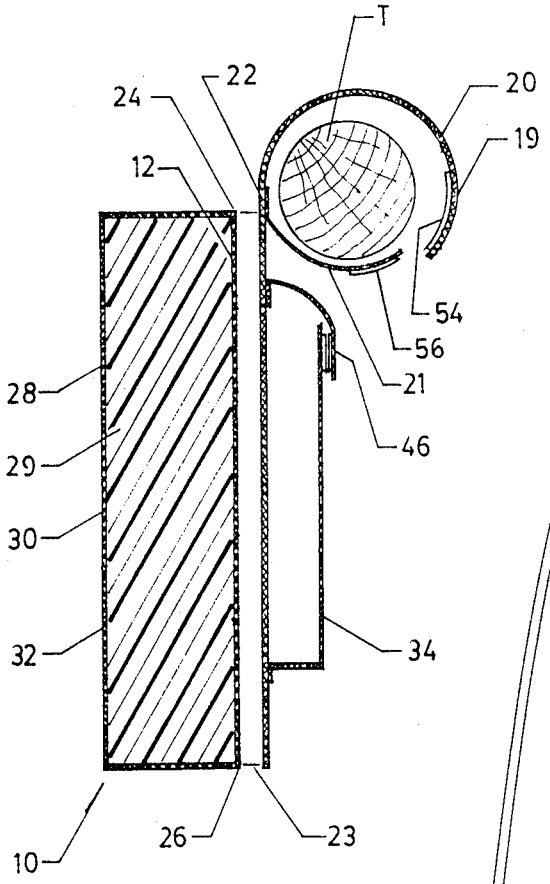
FIG. 2 is a vertical cross section of the assist attached to the thwart of a canoe.
Figure 3:
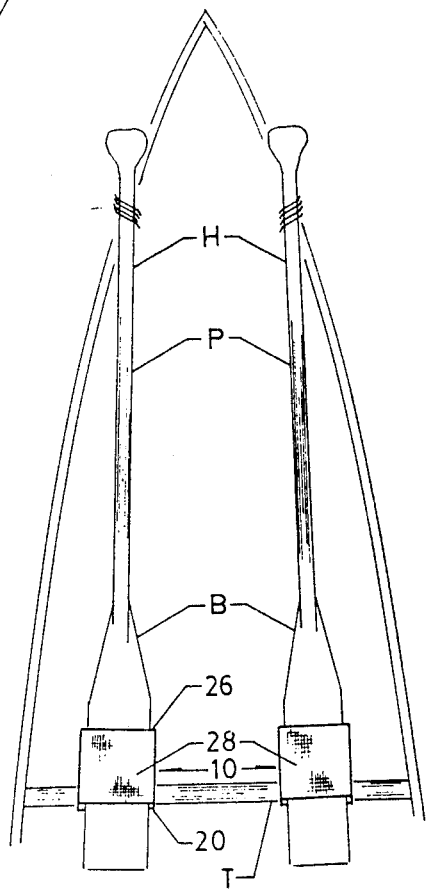
FIG. 3 is a plan view from above of the forward end portion of a canoe showing paddles secured thereto using the assist in preparation for portaging the canoe.

With particular reference to FIGS. 2 and 3, a canoe C is normally provided with a bracing thwart T. Assist 10 is secured to thwart T by wrapping flaps 20 and 44 in opposed directions thereabout, whereby the hook and pile fastener tabs 54,56 are brought into opposition for securement together with the flaps 20,44 together forming a tight, closed loop about the thwart. Normally assist 10 will depend downwardly from thwart T, and pocket 34 may be used for the safe storage of small articles. Removal of the assist 10 is easily accomplished simply by pulling flap 20 upwardly, although the assist is otherwise anchored firmly into place. For use in portaging, assist 10 is rotated about thwart T so that the lower end 26 of the assist, as seen in FIG. 2, is forwardly directed. In this position the blade B of a paddle P is inserted into sleeve 23 so as to fix the paddle relative to the thwart, with cushion pad 28 overlaying a portion of blade B. The haft H of paddle P is lashed to the forward end of canoe C at the gunwhale thereof by any convenient means.

A pair of paddles positioned in the manner shown in FIG. 3 permits the canoe C to be portaged with relative ease with cushion pads 28 resting on the shoulders of the portageur.

While the invention has been described with particular reference to a preferred embodiment, this is illustrative only of one form thereof that is presently preferred. It will be appreciated that the invention may be embodied in other forms that might under other circumstances be preferred. The scope of the invention is to be limited in accordance with the spirit of the claims appended hereto.

We claim:

1. Portaging device for a water craft having a supporting thwart comprising:

a flexible sleeve having an axis therealong and having an opening in each axial end thereof for inserting the blade of a paddle therethrough;

a resilient pad secured to one major surface of said sleeve;

flap means including upper and lower flap portions secured to said sleeve in general opposition to said resilient pad, and a hook fastener secured to one of said upper and lower flap portions and pile fasteners secured to the other to permit said flap means to be formed into a closed loop about said thwart.

2. Portaging device for a water craft having a support thwart comprising:

a flexible sleeve having an axis therealong and having an opening in one axial end thereof for inserting the blade of a paddle therein;

a resilient pad overlaying a portion of said sleeve; on one lateral side thereof;

flap means wholly secured to said sleeve on a lateral side opposed to said resilient pad, and means for releasably retaining said flap means in a closed loop having an axis transverse to the axis of said sleeve and locating on said laterally opposed side thereof.

3. In combination, a water craft having a supporting thwart;

a flexible sleeve having an axis therealong and including an opening in at least one axial end thereof;

a resilient pad overlaying a portion of the major surface of said sleeve, and means secured to said sleeve on a portion of such major surface generally opposed to said resilient pad for releasably attaching said sleeve to said thwart, whereby the blade of a paddle may be secured to said thwart for portaging said water craft and said pad forms a cushion therefrom in the portaging thereof.

4. The combination of claim 3, wherein said sleeve is open at each axial end thereof.

5. A combination as claimed in claim 4, wherein said releasable attaching means comprises a flap means secured to said sleeve for forming a closed loop about said thwart.

6. A combination as claimed in claim 5, wherein said releasable attaching means includes releasable means for holding said flap means in said closed loop.

7. A combination as claimed in claim 6, wherein said releasable means comprises a hook and pile fastener.

8. A combination as claimed in claim 5, wherein said flap means is secured intermediate the ends thereof to said sleeve to provide upper and lower flap portions.

9. A combination as claimed in claim 8, wherein said releasable means comprises one of a hook and pile fastener secured to said upper flap portion and the other of said hook and pile fastener secured to said lower flap portion.

10. A combination as claimed in claim 9, wherein said hook and pile fastener is in the form of at least one elongated strip of hook fastener and at least one elongated strip of pile fastener, and each strip of said hook fastener is secured to said flap means in a first direction and each strip of said pile fastener is secured to said flap means in a direction transverse to said hook fastener.

11. A combination as claimed in claim 3, including a pocket secured to said sleeve on a major surface portion thereof opposed to that upon which said resilient pad is located.

12. A combination as claimed in claim 11, wherein said pocket includes major wall portions common to said sleeve.

13. A portaging device as claimed in claim 1, wherein hook and pile fastener is in the form of at least one elongated strip of hook fastener and at least one elongated strip of pile fastener, and each strip of said hook fastener is secured to said flap means in a first direction and each strip of said pile fastener is secured to said flap means in a direction transverse to said hook fastener.

14. A portaging device as claimed in claim 1, including a pocket secured to said sleeve on a major surface thereof opposed to that upon which said resilient pad is located.

15. A portaging device as claimed in claim 14, wherein said pocket includes major wall portions common to said sleeve.

* * * * *